United States Patent [19]

Okugawa

[11] Patent Number: 4,577,569

[45] Date of Patent: Mar. 25, 1986

[54] APPARATUS FOR HOLDING UNOPERATING NEEDLE BAR OF BRAIDING MACHINE

[75] Inventor: Yoshio Okugawa, Iruma, Japan

[73] Assignee: Hiraoka Kogyo Kabushiki Kaisha, Hanno, Japan

[21] Appl. No.: 533,942

[22] Filed: Sep. 20, 1983

[30] Foreign Application Priority Data

Sep. 20, 1982 [JP] Japan ..... 57-162165

[51] Int. Cl.[4] ..... D05C 3/04; D05B 55/16

[52] U.S. Cl. ..... 112/83; 112/221

[58] Field of Search ..... 112/83, 84, 221, 98, 112/86

[56] References Cited

U.S. PATENT DOCUMENTS

| | | | |
|---|---|---|---|
| 3,172,380 | 3/1965 | Boyles | 112/221 X |
| 3,349,733 | 10/1967 | Ree | 112/83 |
| 3,547,058 | 12/1970 | Brown et al. | 112/221 X |
| 3,724,405 | 4/1973 | Mullen, Jr. | 112/221 |
| 3,884,165 | 5/1975 | Tajima | 112/83 |
| 4,054,098 | 10/1977 | Hoever et al. | 112/221 X |

*Primary Examiner*—H. Hampton Hunter

*Attorney, Agent, or Firm*—Oblon, Fisher, Spivak, McClelland & Maier

[57] ABSTRACT

An apparatus for holding a plurality of needle bars of an embroidery machine which includes a support upon which the needle bars are reciprocably mounted; a moving block connected to each of the needle bars for advancement and retraction thereof and including a stopper extending therefrom at a right angle to a direction of movement of the moving block; a driving band connected to the moving block and which includes a locating plate; and a plurality of L-shaped operating levers corresponding to the needle bars, each of the levers including an inclined surface positioned at a front portion thereof and supported on the support so as to be freely rotatable and which includes a mechanism for fixing the needles in an idle position. A plurality of solenoids are also provided which have operation bars attached thereto and which are respectively rotated by the solenoids. A plurality of engagement levers are also provided each of which includes a roller mounted at a rear end thereof for engagement with the inclined surface of the L-shaped operating levers and includes a pressure member for engaging the stopper. A coil spring is also utilized for biasing the engagement mechanism upwardly so as to connect the engagement mechanism and the moving block upon advancement of the moving block.

1 Claim, 8 Drawing Figures

(A)

(B)

(C)

APPARATUS FOR HOLDING UNOPERATING NEEDLE BAR OF BRAIDING MACHINE

BACKGROUND OF THE INVENTION

1. Field of the Invention

The instant invention relates to a holding apparatus for idle needle bars of an embroidering machine.

2. Description of the Prior Art

A conventional apparatus of this type has been constructed so that projections from and concavities in an outer drum surface of a control shaft are utilized, and serve to hold the needle bar by releasing engagement of a pawl used for driving the needle bar. Therefore, disadvantages accompanied the conventional machine in that a control shaft was necessary to be installed to cover the total length of the laterally embroidery length, sufficient consideration was necessary as to the accuracy of assembly, the strength at various joint positions, etc., and a sophisticated holding mechanism and operation mechanism was required for smooth operation of the control shaft.

SUMMARY OF THE INVENTION

In consideration of the above disadvantages of the conventional machines, the instant invention provides an apparatus for holding the idle needle bars of an embroidering machine and includes a solenoid which is simply and surely operable while eliminating the need for a control shaft and without using a rotating mechanism.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DETAILED DESCRIPTION OF THE PREFERRED EMBODIMENT

Figure 1:
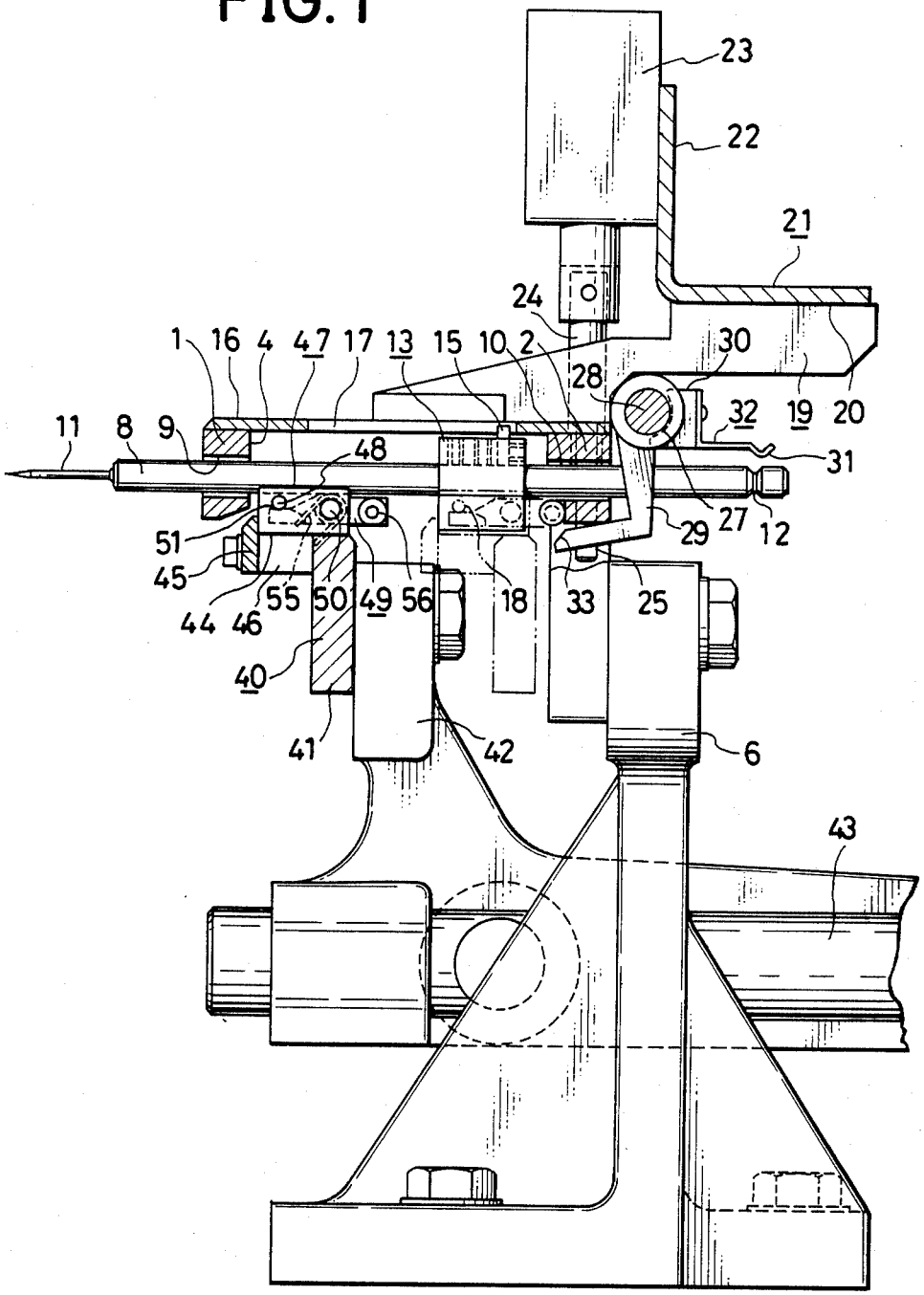
FIG. 1 is a partially cut side view of the present invention.
Figure 2:
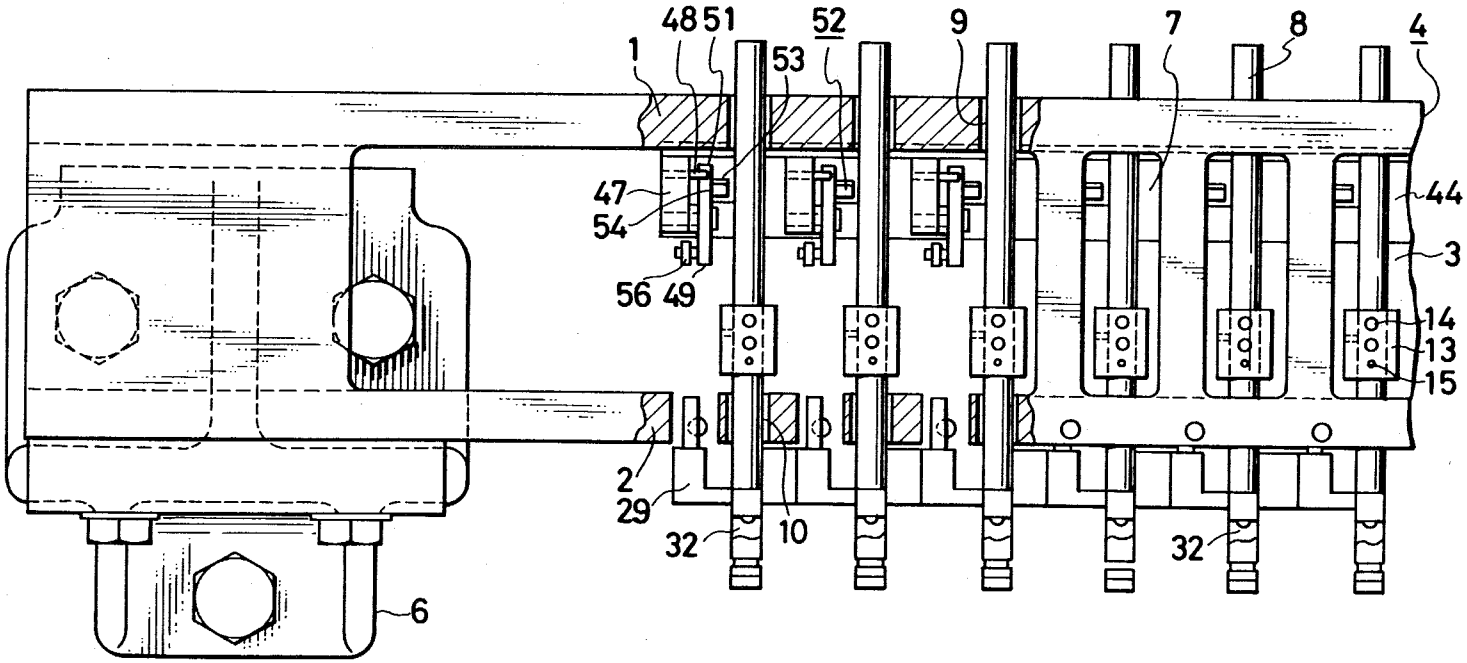
FIG. 2 is a partially cut plan view.
Figure 3:
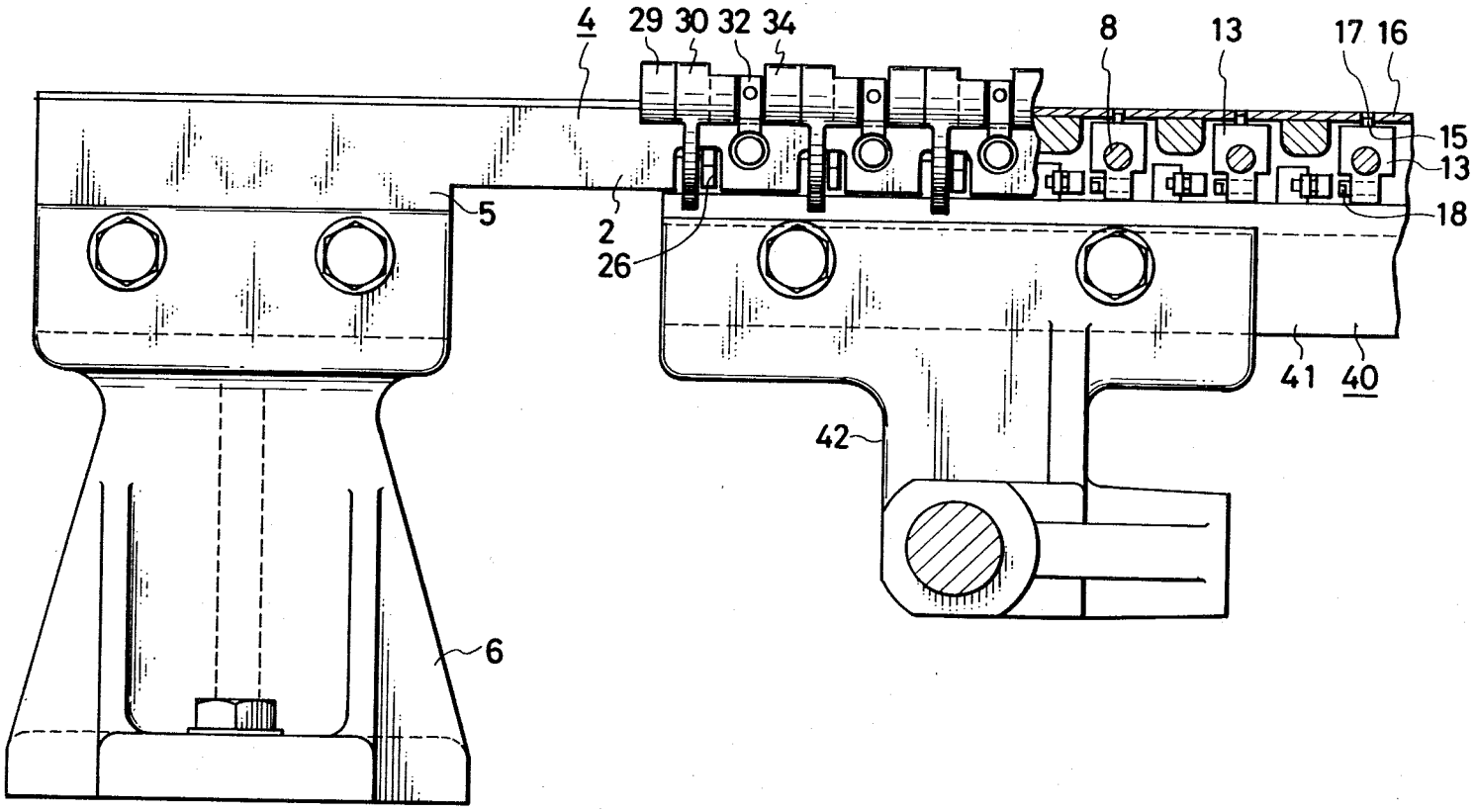
FIG. 3 is a partially cut rear elevation.

With particular reference to the drawings of example embodiment, the details of this invention are explained as follows: As shown in FIGS. 1–3, projecting parts 5 extend from underneath the supporting table 4 which has a ¬ formed section which includes a short front face wall 1 and a long rear face wall 2 and are connected by a top plate 3. The projecting parts 5 are in turn supported by respective legs 6. The top plate 3 of the supporting stand 4 has a plurality of guide long holes 7 formed therein between the front and rear face walls 1, 2. A plurality of needle bar holes 9, 10 for inserting needle bars 8 are respectively formed in front face wall 1 and rear face wall 2 on a line of extension of the center line of each guide long hole 7. In addition, a needle 11 is attached at an end of each needle bar 8, and an engaging groove 12 is formed in a rear end portion of each needle bar 8.

Figure 4:
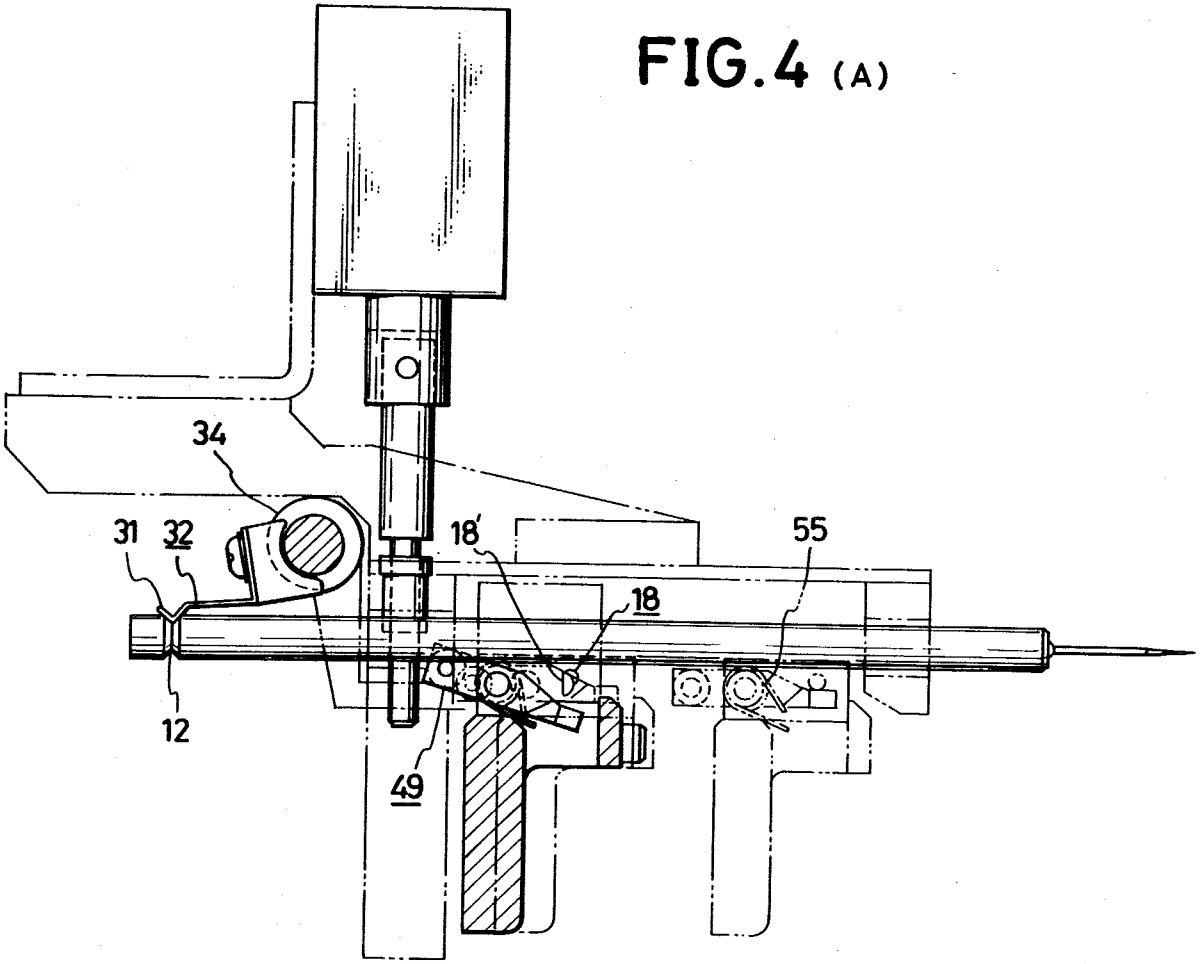
FIG. 4(A) is a side view showing a needle bar in an idle position.
FIG. 4(B) is a side view showing an operating needle bar.
Figure 4:
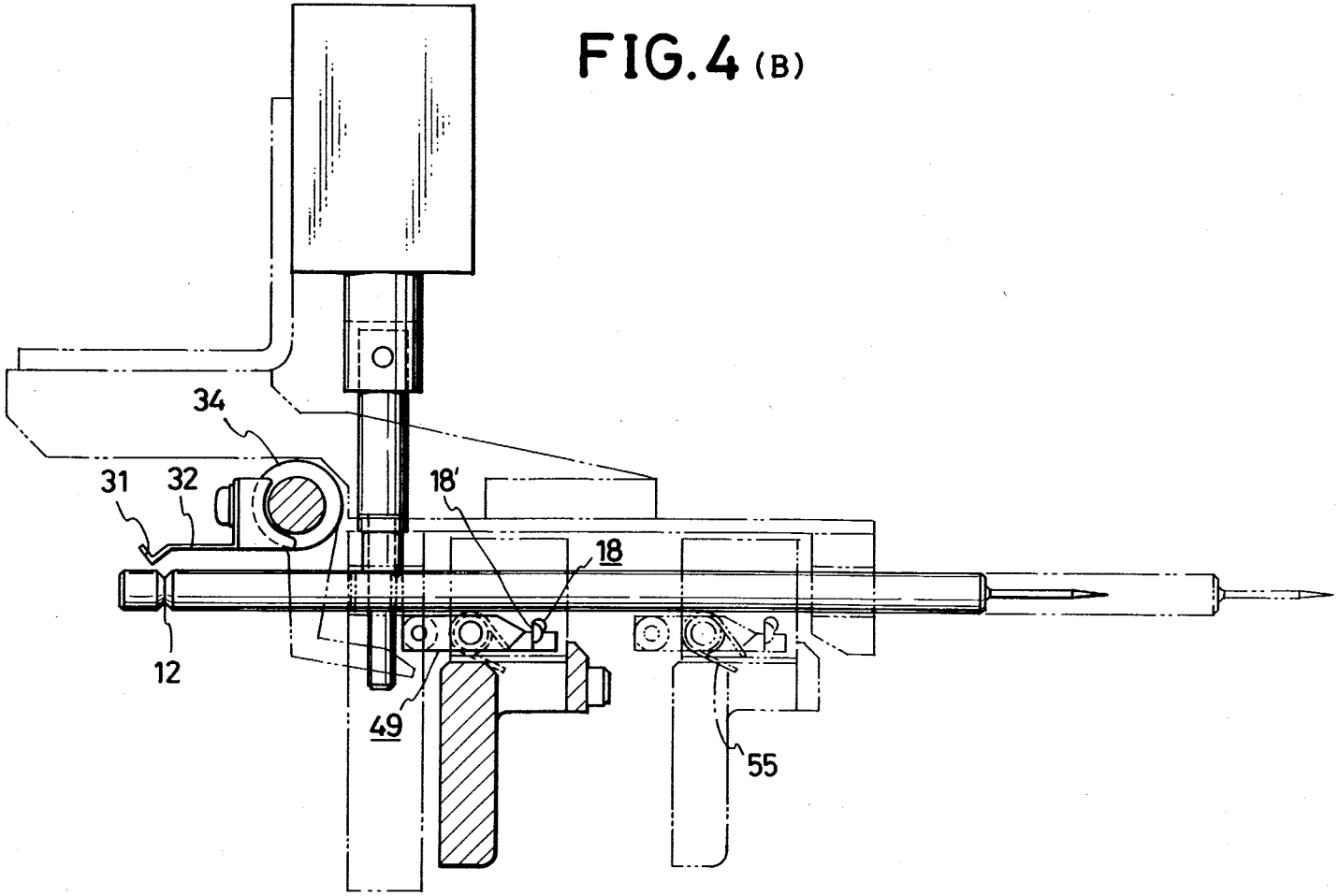

A moving block 13 is attached to a center portion of each needle bar 8, and is fixed by two set screws 14 and 14 from the upper side. An arresting pin 15 is used at the rear of the upper face of the moving block 13 to prevent rotation of the needle bar 8 and is inserted into a groove 17 formed in a stopping board 16 fixed to the upper face of the supporting table 4. The width of the undersurface of the moving block 13 is dimensioned so as to have a small width as shown in FIG. 3, and has a stopper 18 inserted therein on a front end thereof which extends so as to be within the plane of the side face of the block 13. The stopper 18 has a vertical face 18' formed on a rear end side thereof as shown in FIG. 4(A).

Figure 5:
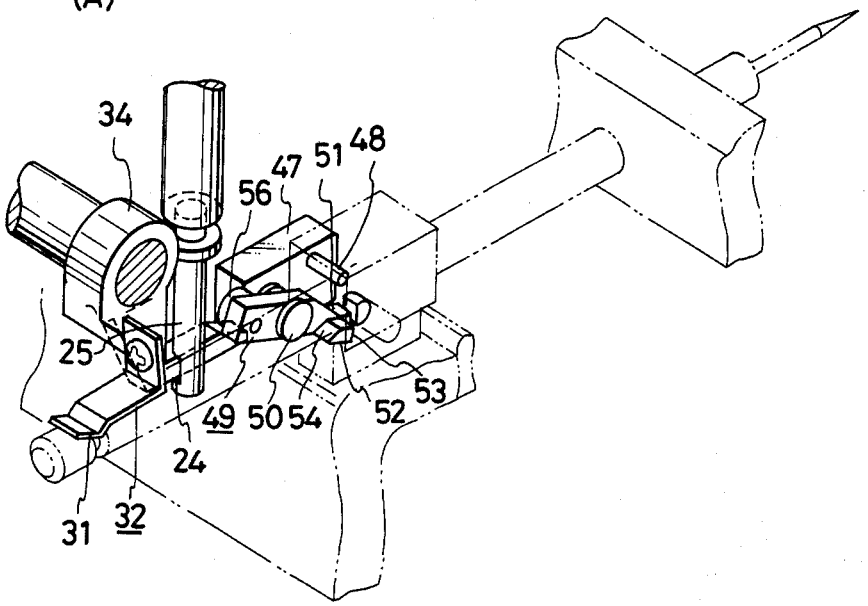
FIG. 5(A) is a perspective view which represents the idle position of the needle bar.
FIG. 5(B) is an interim position in operation of the needle bar.
FIG. 5(C) illustrates the most advanced position of the needle bar.
Figure 5:
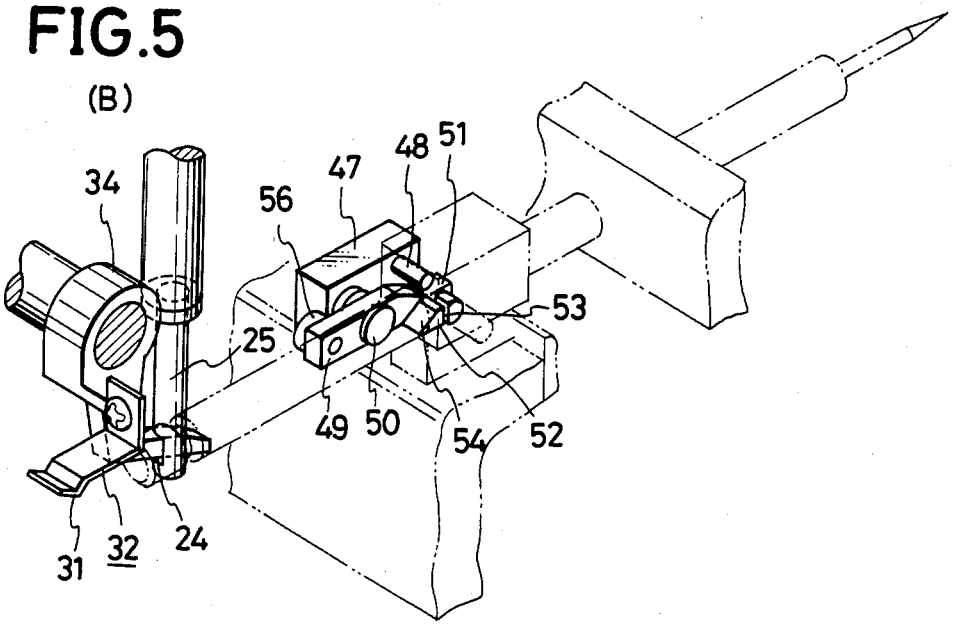
Figure 5:
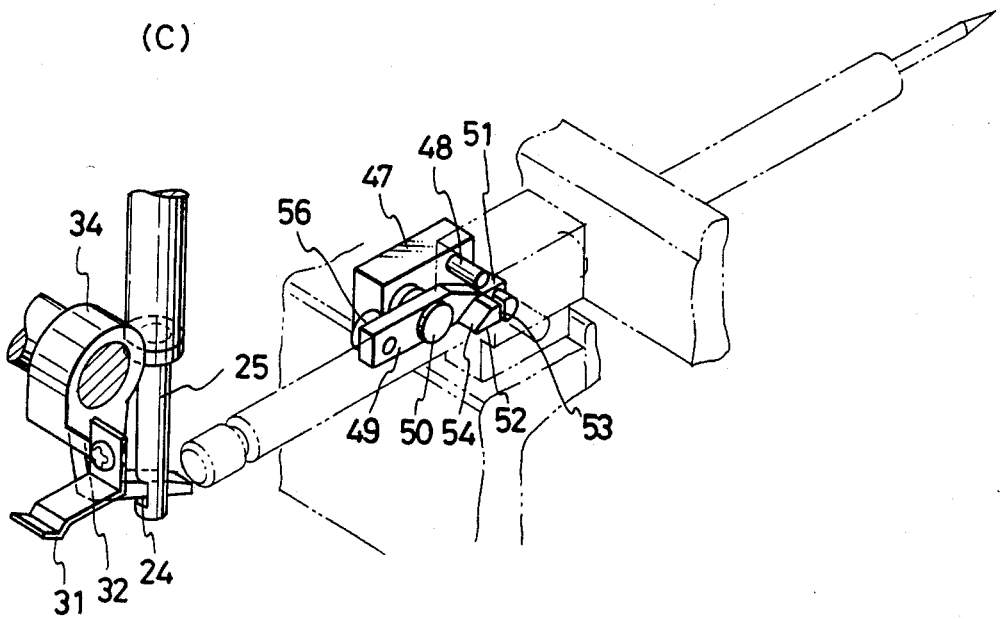

A bracket 19 is fixed to opposite sides of the surface of the stopping board 16, rear end portions thereof projecting toward the rear side of the stopping board 16 and, to the upper face of a rear end supporting part 20 thereof, an L-shaped solenoid supporting plate 21 is fixed. A plurality of solenoids 23 corresponding to the quantity of needle bars 8 are vertically fixed to a vertical part 22 of the solenoid supporting plate 21. A plurality of operation bars 24 are connected to solenoid 23 and a lower portion of each pass through the stopping board 16 and the rear face wall 2 of the supporting stand 4. A notched part 25 is formed in the lower end of each operation bar 24 as shown in FIG. 5. A notched hole 26 is formed in part of the rear face wall 2 for housing a lower end of each operation bar 24.

A plurality of bearings 27 are respectively fixed at predetermined intervals on the upper surface of the rear portion of the stopping board 16 so as to project outwardly, and a supporting shaft 28 is inserted through each of the bearing 27 to engage an upper end of one of a plurality of L-shaped operation levers 29 so as to rotate freely. A collar 30 engages the supporting shaft 28. An elastic plate needle bar stopper 32 having an engaging part 31 which fits into the engaging groove 12 is fixed to collar 30. A free end of each operation lever 29 is fitted within the notched part 25 of each operation bar 24, and an upwardly inclined surface 33 is formed at a front end of lever 29. Numeral 34 denotes a spacer positioned between each operation lever 29.

A driving arm 42 is fixed to opposite ends of a vertical wall 41 of a driving band 40 which is ¬ shaped, and a drive shaft 43 is connected to the driving arm 42 to shift the driving band 40 parallelly in a forward and reverse direction. At the front of a horizontal wall 44 of the driving band 40 is a locating plate 45 fixed and has an upwardly projecting end, and a plurality of operation holes 46 corresponding to the needle bars 8 are formed with a predetermined spacing in the horizontal wall 44 between the plate 45 and vertical wall 41. A plurality of fittings 47 equal to the number of operation holes 46 are fixed to the horizontal wall 44. Location pins 48 horizontally project from the front end side of the fittings 47, and the engaging lever 49 is pivotally attached to this assembly with a pin 50 to rotate freely. The engaging lever 49 is provided with a location surface 51 at a position a step lower than the forward end upper surface, and at the rear of the locating surface 51 and at an opposite side of the fitting 47 a pressing member 52 (refer to FIG. 5) projects therefrom, such that the front side of this pressing member 52 serves as a pressure surface 53, and a relief surface 54 is formed by making the opposite upper face inclined. Then one end of a coil spring 55 installed to coil around the pin 50 engages the bottom surface of the engaging lever 49, and an opposite end is inserted into the operation hole 46 of the driving band 40 to press the connection lever 49 upwardly such that the locating surface 51 engages location pin 48. The rear end of the engaging lever 49 projects out from the driving band 40, and a roller 56 which engages with the inclined surface 33 of the operation lever 29 is attached to the rear end so as to be free to rotate.

The instant invention is constituted as explained above, and in the usual use of needle bar 8, the solenoid 23 is not operated and the operation lever 29 is positioned such that the front end side is at the lower position as shown in FIG. 1 and FIG. 4(B). When the driving band 40, under this condition, is positioned at the rear end side as shown by solid line in FIG. 4(B) and FIG. 5(B), the engaging lever 49 is pushed upwards by the coil spring 55, and the locating surface 51 is engaged with the lower surface of the location pin 48, and is in the horizontal condition. Under this condition, pressure surface 53 of the pressing member 52 of the engaging lever 49 is engaged with the vertical surface 18' of the stopper 18, and the engaging lever 49 and moving block 13 are connected. Therefore, when the driving band 40 is advanced as shown by the chain line position of FIG. 4(B) and FIG. 5(C), the needle bar 8 is advanced through the moving block 13. In case of retraction of needle bar 8, moving block 13 is retracted simultaneously because the locating plate 45 fixed to the driving band 40 is engaged with the front face of the moving block 13, and the needle bar 8 is retracted. The advance and retraction of the needle bar 8 serves to perform the embroidering operation as is known.

In case of fixing an arbitrary needle 11, solenoid 23 is operated to attract operation bar 24, then the operation lever 29 rotates making the supporting shaft 28 the center of rotation and causes the end of engaging lever 49 to rise up, as shown in FIG. 4(A) and FIG. 5(A). The rotation of operation lever 29 makes needle bar stopper 32 descend and the engaging part 31 is inserted into the engaging groove 12 of the needle bar 8 and the needle bar 8 is prevented from moving. On the other hand, inclined surface 33 at the end of the operation lever 29 causes roller 56 of the engaging lever 49 to move upwards, makes engaging lever 49 rotate around the pin 50 and makes the end point face down. By this downward facing of the point end, the pressure surface 53 of the pressing member 52 moves off from the stopper 18 of the moving block 13. Under this condition, when the driving band 40 is advanced, the roller 56 moves along the inclined surface 33 of the operation lever 29, and the engaging lever 49 moves so as to be maintained in an inclined condition, and the engaging lever 49 is then oriented in a horizontal condition by the action of the coil spring 55 insofar as the pressing member 52 has already passed the position of the stopper 18, at the position of the roller 56 has left from the inclined surface 33. Therefore, only the stopping lever 49 advances while the moving block 13 is held in the original position.

In the case of retraction of the needle 8, the roller 56 reaches the inclined surface 33 of the operation lever 29. Then the relief surface 54 of the pressing member 52 is contacted by the stopper 18. By retracting further under this condition, the roller 56 rises up along the inclined surface 33, rotates the engaging lever 49, and moves around the circular arc surface of the stopper 18 because of the inclination of the relief surface 54 and returns to the original position. Therefore the needle bar 8 remains stopped in spite of the reciprocating movement of the driving band 40.

When an arbitrary needle bar 8 is to be fixed during the operation of the needle bar 8; by actuating the solenoid related to positioning of this needle bar 8, the operation lever 29 is in the position as shown in FIG. 4(A) and FIG. 5(A) as stated above. Therefore, the needle bar 8 continues to move with the movement of the driving band 40 during the advancing and retracting movement of the needle bar 8, and the engaging lever 49 is inclined at the retiring end part as stated, and engaging part 31 of the needle bar stopper 32 is inserted into the engaging channel 12 of the needle bar 8 at the rear end position, and then the needle bar 8 is stopped.

Further in the above exemplary embodiment, L-shaped solenoid supporting part 21 is fixed above the rear end supporting part 20, and the solenoid 23 is fixed in a vertical position by this solenoid supporting plate 21. However, the fixing position of the solenoid shall not necessarily be limited to this exemplary embodiment, and the solenoid 23 may be installed parallel and to the rear of the needle bar 8, or any place which enables rotation of the operation lever 29.

The present invention has the constitution and function as stated above, and has superior effects noted as follows:

(1) In comparison with a conventional apparatus for holding an idle needle bar by using punched holes on cardboard to convert mechanical signal to the electrical signal to maintain the inoperative position, and indexing the control shaft by reducing the speed of the control shaft, the instant invention allows for maintaining the rotation of the embroidering machine accurately without reducing speed by employing a solenoid.

(2) The conventional control shaft is constructed so that projections and concavities extend from and are formed in the outer drum surface of the control shaft, and the number of permutations and combinations of the position of the idle needle bar is determined by the arrangement of the projections and concavities. The arrangement of the projections and concavities shall be changed or the control shaft shall be changed for producing a change of this permutation, and it is also difficult to prepare the varieties of arrangements of projections and concavities for the various number of combinations because of the mechanical and spatial restrictions. However, the instant invention allows for maintaining an idle position of the needle bar for a predetermined order and combination of needle bars by storing the order of holding unoperating positions of the needle bar into the memory of an electrical control apparatus, and allows for broidering of irregularly arranged pattern embroidery. Further, a large pattern embroidering within an up and down, left and right moving range of the embroidery pattern can also be made without removing the unused needle as has been required by conventional machines.

(3) In the conventional control shaft system, for some embroidery pattern, arrangement of projections and concavities prepared on the outer drum surface of the control shaft is generally arranged to select the holding of successive inoperative positions alternatively in accordance in the cases (1) of holding of the idle position of all the needle bars arranged along the whole laterally long embroidering range not being necessary, (2) of holding alternative idle positions of the neighboring 2 needles, and (3) similarly of holding the mutual idle position of successive needles 3, 4, and it being necessary for the control shaft to be rotated in a clockwise or counter clockwise direction for maintaining the idle position of two or more needle bars. However, in the present invention which uses a solenoid, the idle position can be successively held simply and for a short time span by storing the position memory in an electric control equipment.

(4) The instant invention can include a needle bar suspension mechanism to perform interim holding of the needle bar in the idle position without relation to the solenoid operation but, as in the case where the solenoid was operated, also enabling stopping of only the needle bar with cut yarn without stopping the whole machine, and thus can improve the operation rate of the machine.

What is claimed as new and desired to be secured by Letters Patent of the United States is:

1. An apparatus for holding a plurality of needle bars of an embroidering machine, comprising:

support means upon which said needle bars are reciprocably mounted;

a moving block connected to each of said needle bars for advancement and retraction thereof and having stopper means extending therefrom at a right angle to a direction of movement of said moving block;

a driving band connected to said moving block and which includes a locating plate;

a plurality of L-shaped operating lever means corresponding to said needle bars, each of said levers including an inclined surface positioned at a front portion thereof and supported on said support means so as to be freely rotatable, said lever means including means for fixing said needles in an idle position;

a plurality of solenoids having operation bars attached thereto which are respectively rotated by said solenoids;

a plurality of engagement levers each of which includes a roller mounted at a rear end thereof for engagement with said inclined surface of said L-shaped operating lever means and a pressure member for engaging said stopper means; and means for biasing said engagement means upwardly so as to connect said engagement means and said moving block upon advancement of said moving block.

* * * * *